United States Patent [19]

Wiig

[11] 3,992,957

[45] Nov. 23, 1976

[54] ROTARY TYPE SHAPER MOTION DRIVE

[75] Inventor: Chester M. Wiig, Lincolnwood, Ill.

[73] Assignee: F. J. Littell Machine Company, Chicago, Ill.

[22] Filed: Aug. 12, 1974

[21] Appl. No.: 496,513

[52] U.S. Cl. ..... 74/67; 74/600

[51] Int. Cl.[2] ..... F16H 21/14

[58] Field of Search ..... 74/600, 67

[56] References Cited

UNITED STATES PATENTS

| | | | |
|---|---|---|---|
| 2,893,251 | 7/1959 | McWethy | 74/600 |
| 3,161,067 | 12/1964 | Möller | 74/600 |
| 3,216,277 | 11/1965 | Groll | 74/600 |
| 3,557,639 | 1/1971 | Homstead | 74/600 |

FOREIGN PATENTS OR APPLICATIONS

| | | | |
|---|---|---|---|
| 446,566 | 7/1942 | Canada | 74/67 |

*Primary Examiner*—Samuel Scott
*Assistant Examiner*—Wesley S. Ratliff, Jr.

[57] ABSTRACT

The rotary drive unit for forming or punch presses and the like has an interposed relation between the drive shaft of the press and the face plate to which the reciprocating rack is pivotally secured. One end of a link member is pivotally connected to an eccentric crank pin carried by a drive ring fixed to the drive shaft and rotated thereby, and the other end of the link member is pivotally connected to a second eccentric crank pin carried by a circular disc member mounted for rotation in a housing provided by the press, the disc member having a center of rotation spaced a distance from the axis of rotation of the drive shaft. With the drive shaft rotating at uniform speed, the disc member functions as a driven member and rotates at a speed which is non-uniform. More specifically the face plate will rotate to impart a complete feeding stroke of 180° to the rack for a minor portion of each revolution of the press drive shaft followed by a complete return stroke of the rack of 180° for the remaining major portion of each revolution of the drive shaft.

5 Claims, 14 Drawing Figures

Figure 13:
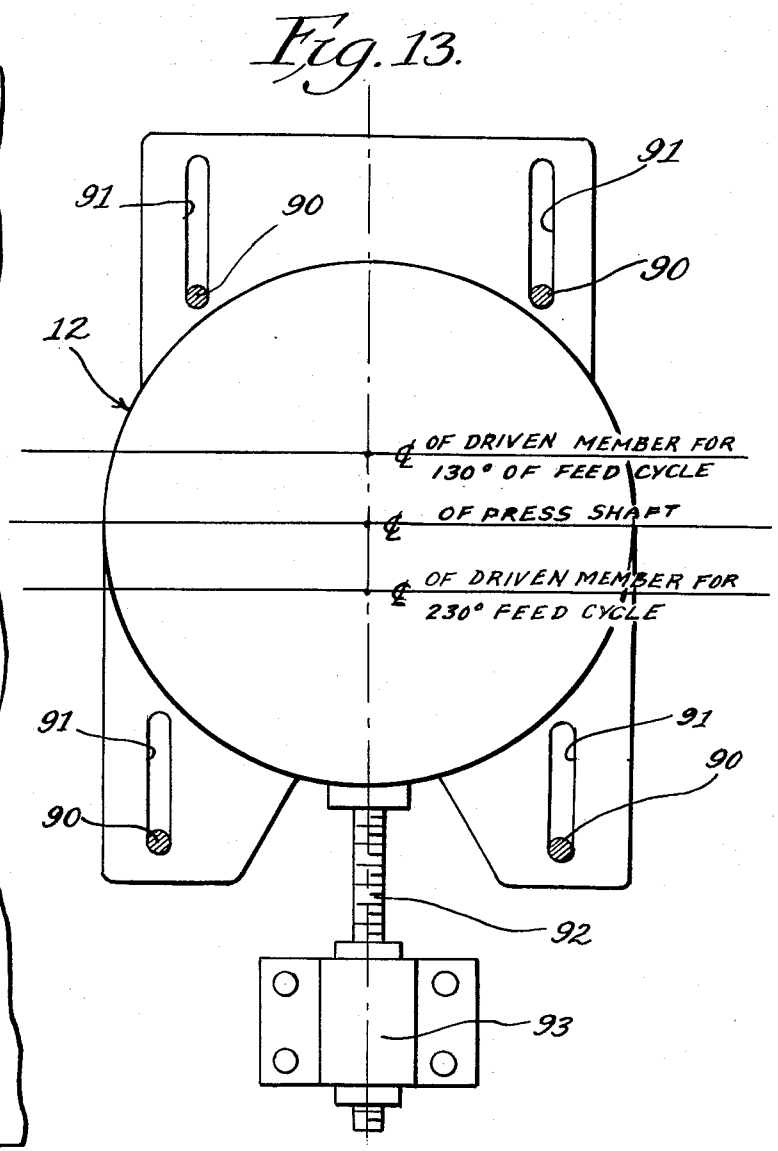

POSITION OF LINK AND RECIPROCATING RACK AT START OF FEEDING CYCLE.

POSITION OF LINK AND RECIPROCATING RACK MIDWAY OF QUICK FEEDING CYCLE.

POSITION OF LINK AND RECIPROCATING RACK AT END OF QUICK FEEDING CYCLE.

POSITION OF LINK AND RECIPROCATING RACK MIDWAY OF SLOW RETURN CYCLE.

ROTARY TYPE SHAPER MOTION DRIVE

The invention relates to mechanism for feeding strip material to a forming or punch press or the like and has reference in particular to novel rotary mechanism for actuating a reciprocating rack in a manner to impart intermittent rotation to the feed rolls of the press, with a minor portion of each revolution of the drive shaft of the press and the remaining major portion of each revolution both producing a complete 180° stroke of the reciprocating rack.

In the feeding of metal strip material for forming, cutting or punching operations, it has been conventional procedure to employ co-acting feed rolls which are actuated intermittently from a main drive shaft through a reciprocating rack and a one-way clutch of the ratchet or overrunning type. The feed rolls are accelerated from an idle position to maximum speed during each operative stroke of the reciprocating rack, and said rolls remain at rest during the return or inoperative stroks of the rack.

The present rotary drive structure is an improvement over the the shaper arm motion for actuating the reciprocating rack as shown in the Budlong U.S. Pat. No. 3,089,345 granted May 14, 1963 and entitled Drive Arm Structure for Reciprocating Mechanism. In said patent the drive structure is oscillated by a crank arm rotating with the drive shaft of the press. It is possible to obtain a feeding stroke when the drive structure is oscillated in a down direction and a quick return stroke when the said structure is oscillated in an up direction, both being produced by proper rotation of the press drive shaft for each revolution.

An object of the present invention is to provide intermittent feeding mechanism of the character described for feeding strip material and wherein the drive structure for the reciprocating rack will consist of novel and improved parts designed for and having rotary movement.

Another object of the invention resides in the provision of a rotary drive unit consisting essentially of a link member having bodily rotation within a circular housing and also having pivotal movement at respective ends since each end of the link member has a pivotal connection to its particular rotatable member, said members being designed for and having rotation on centers spaced from each other, whereby with the driving member having rotation at uniform speed, the driven member is caused to rotate at a speed which is non-uniform.

Another and more specific object is to provide a rotary drive unit having an interposed relation between the drive shaft of the press and the face plate to which the reciprocating rack is pivotally secured and werein said drive unit includes a link member having operation as to cause such rotation of the face plate as to impart a complete feeding stroke of 180° to the rack for a minor portion of each revolution of the press drive shaft followed by a complete return stroke of the rack of 180° for the remaining major portion of each revolution of the drive shaft.

A further objective of the invention is to provide a drive unit of the character described wherein the link member has one end pivoted to a crank pin carried by a drive ring on the press drive shaft and which produces rotation of the link bodily about the axis of the press drive shaft, said link having a crank pin at its other end and which is pivotally connected to a disc member mounted for rotation on a center spaced from the center of rotation of the press drive shaft, whereby with the drive shaft rotating at uniform speed, the disc member is given such non-uniform rotation as regards speed as to impart a complete feeding stroke of 180° to the rack for a minor portion of each revolution of the drive shaft and a complete return stroke of 180° for the remaining major portion of each revolution of the drive shaft.

A still further object is to provide a drive unit of the character and having the mode of operation described wherein the head portion of the reciprocating rack is journalled eccentrically on a face plate secured to and having the same rotary movement as the disc member, and wherein the eccentricity can be manufactured adjusted to any desired setting and then micro-adjusted during press operation for the most accurate and precise feeding.

With these and various other objects in view, the invention may consist of certain novel features of construction and operation as will be more fully described and particularly pointed out in the specification, drawings and claims appended thereto.

Figure 1:
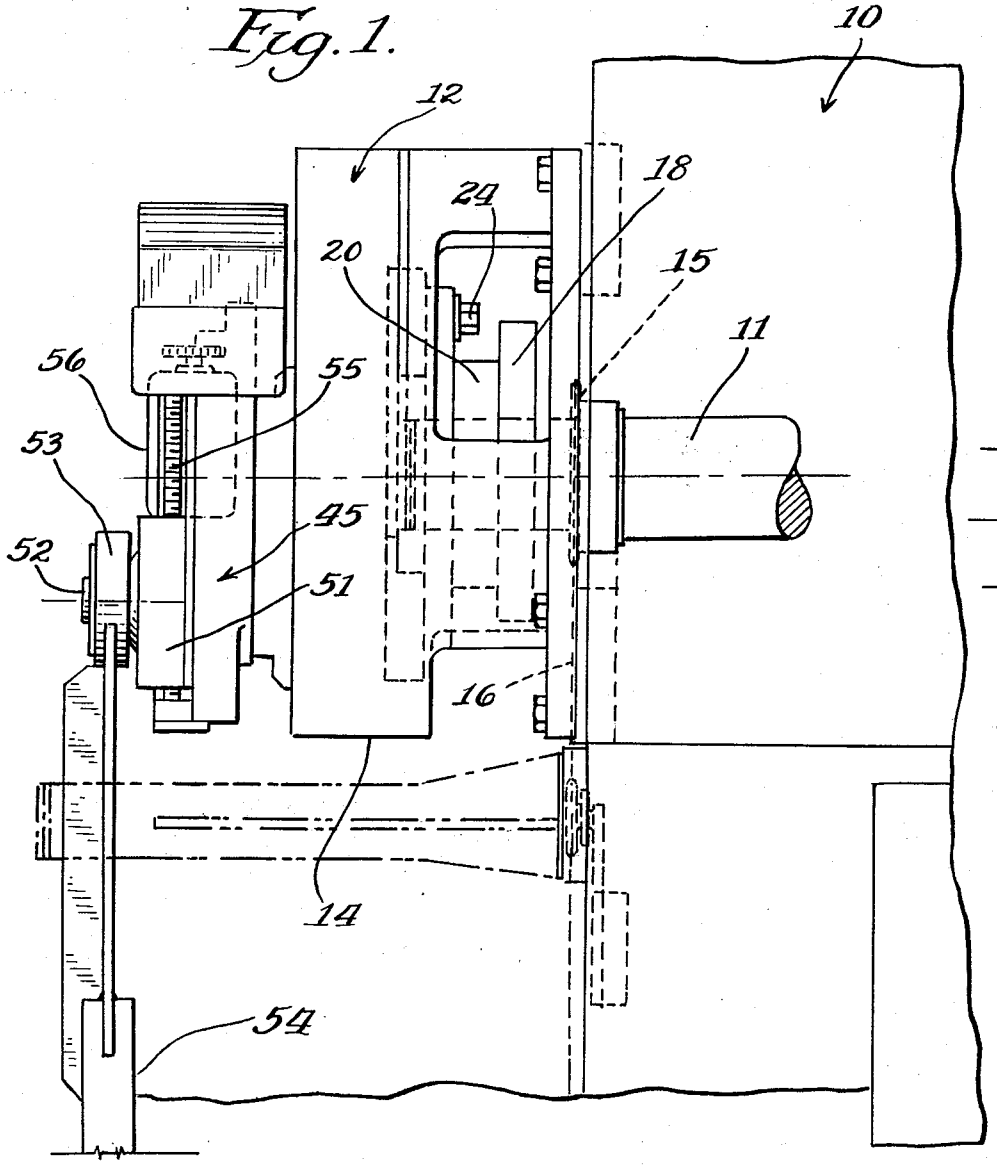
Figure 1A:
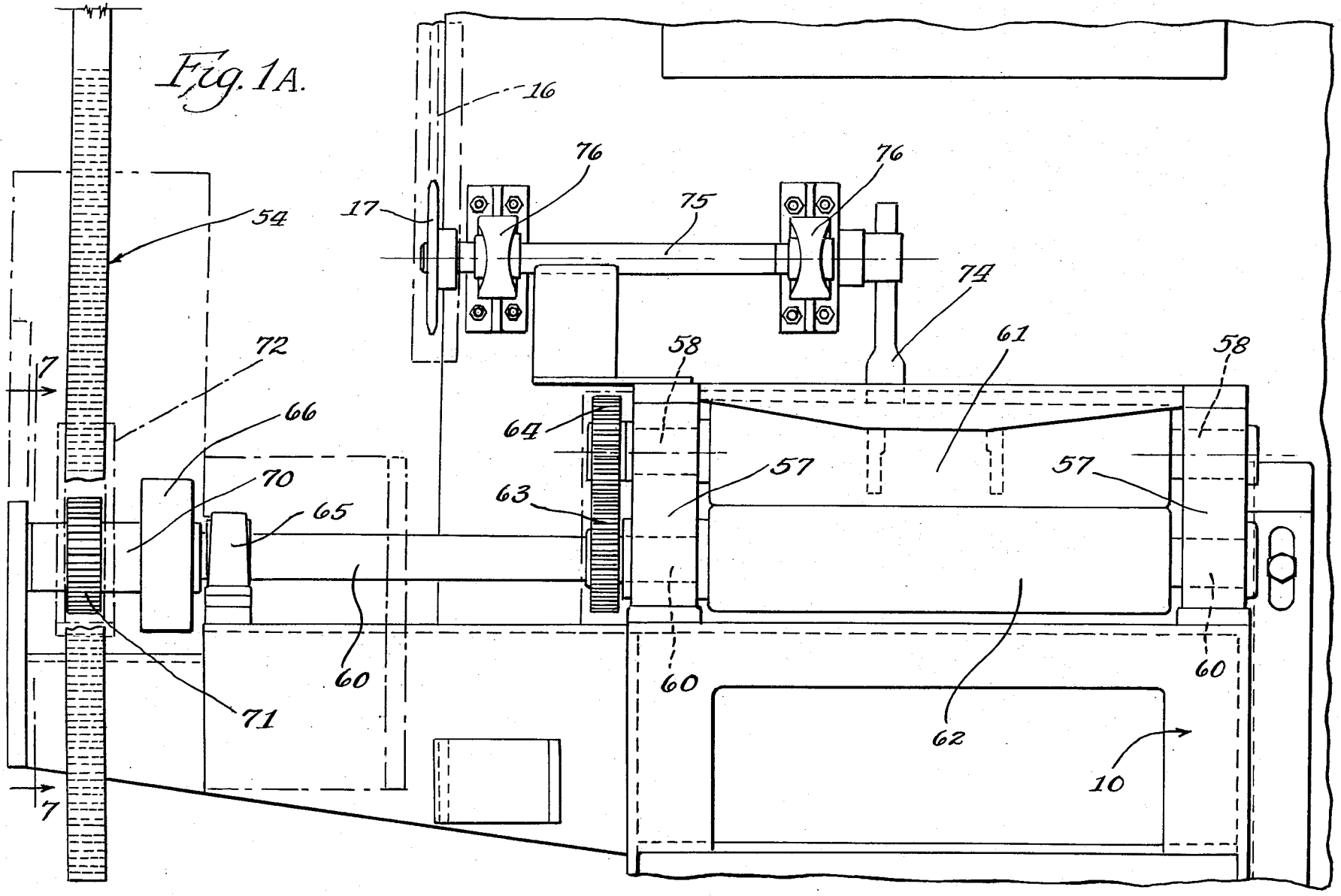
Figure 2:
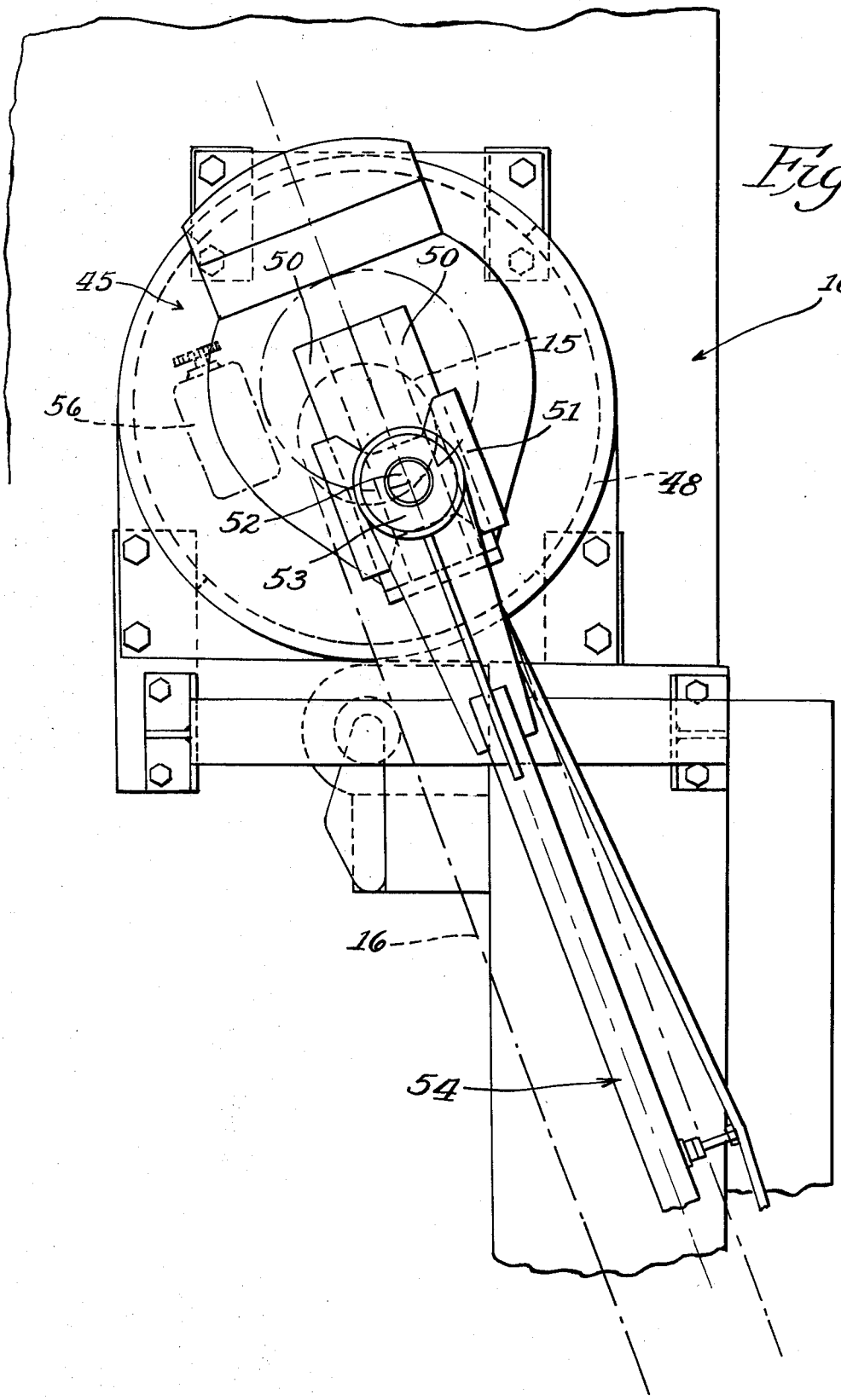
Figure 3:
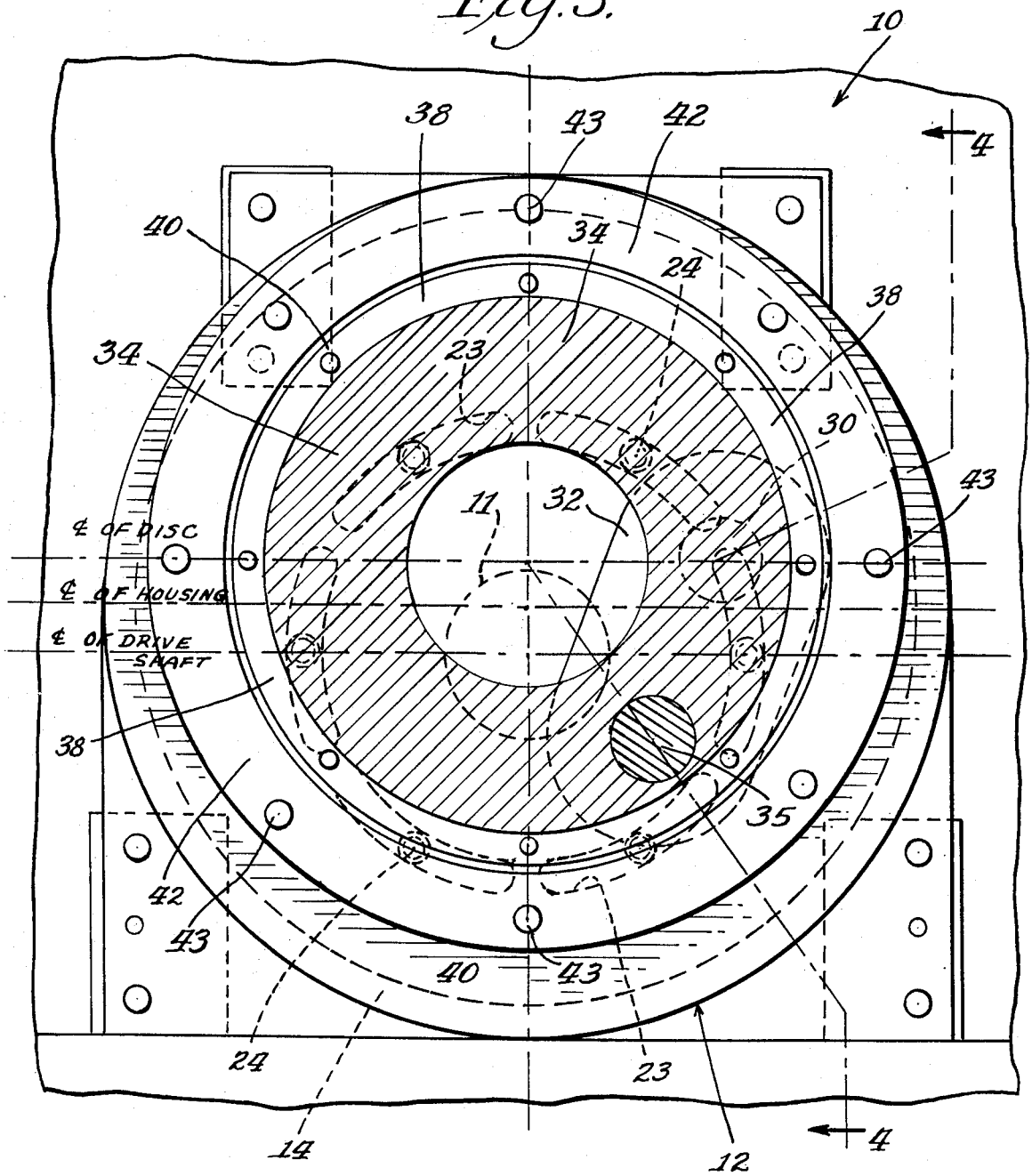
Figure 4:
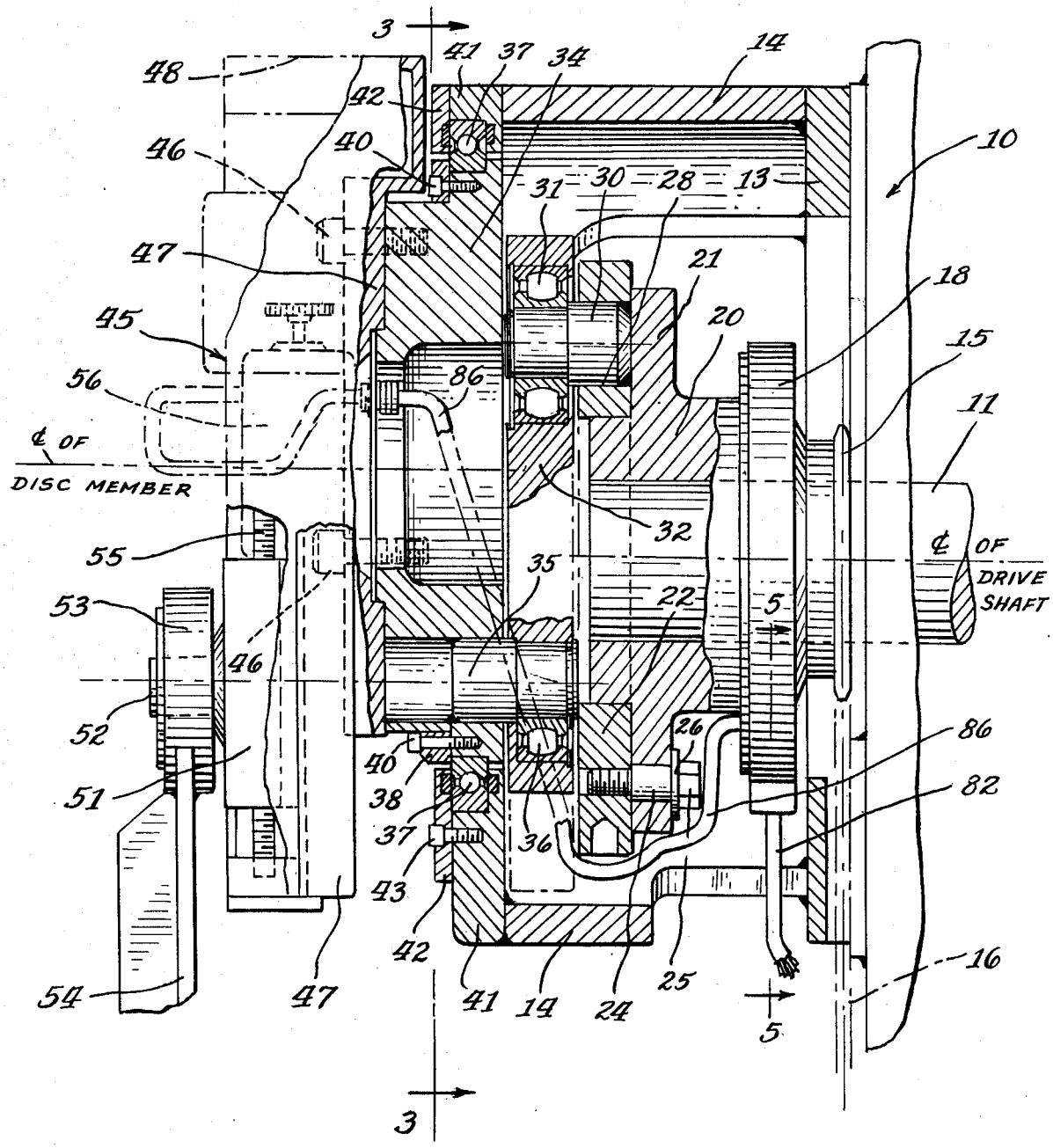
Figure 5:
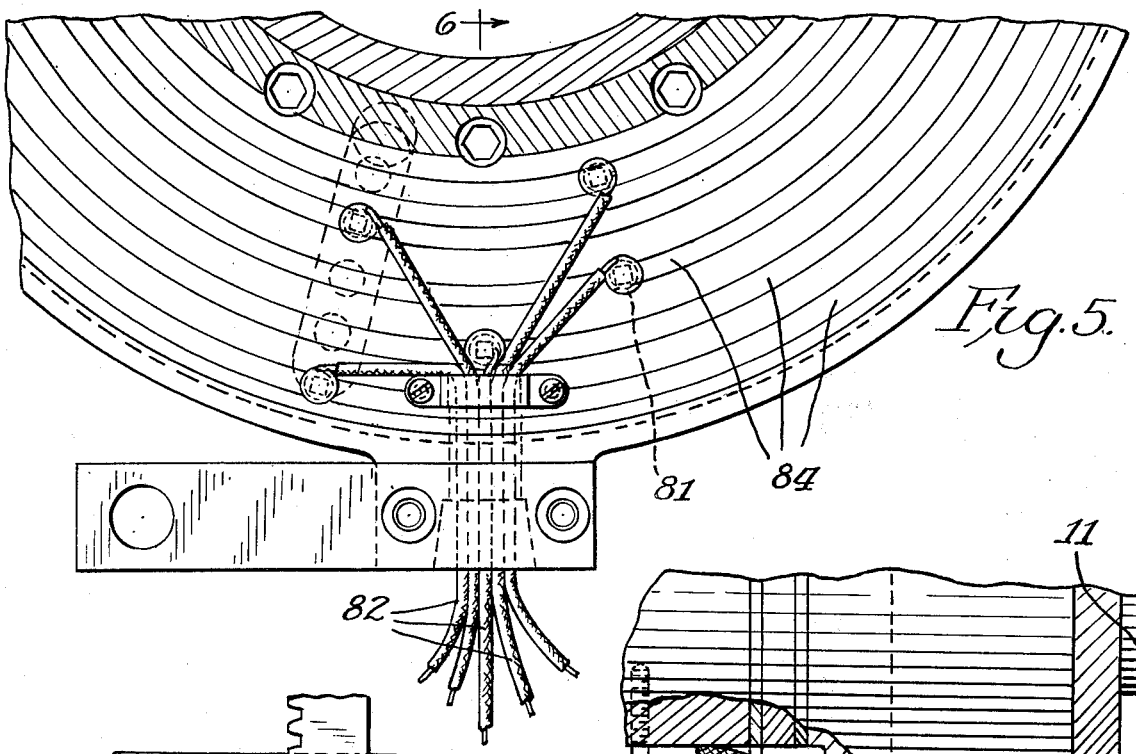
Figure 7:
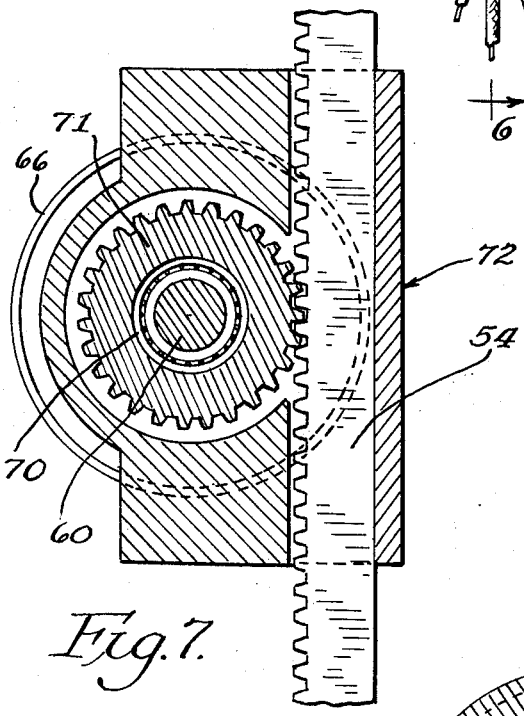
Figure 6:
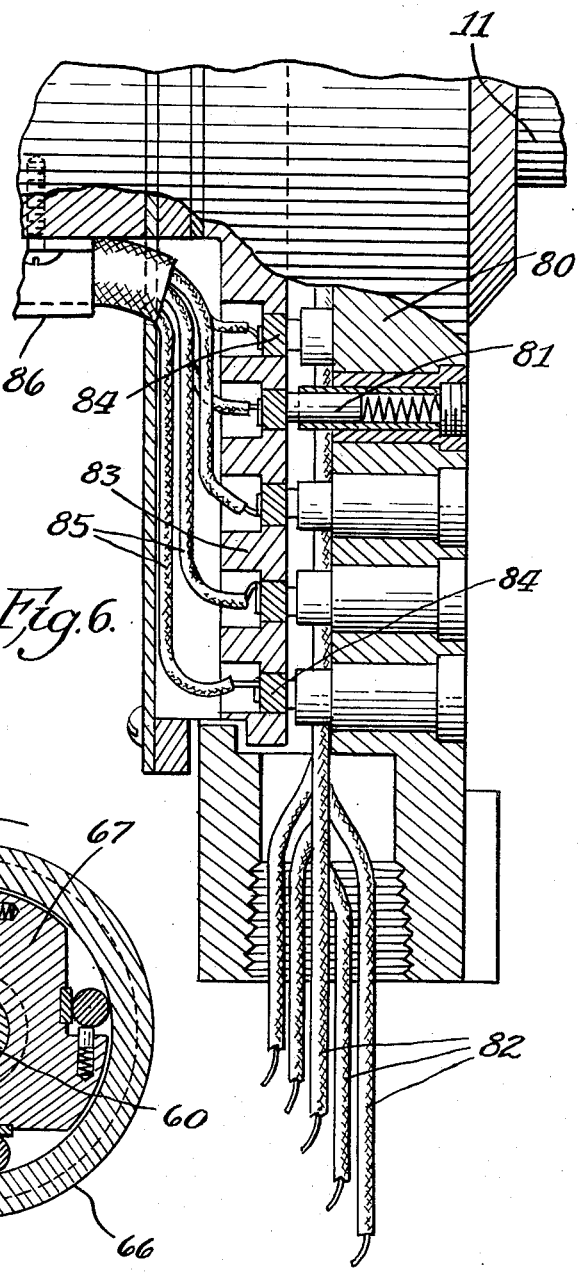
Figure 8:
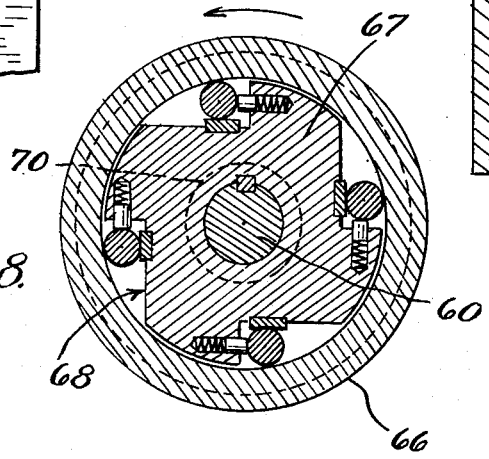
Figure 9:
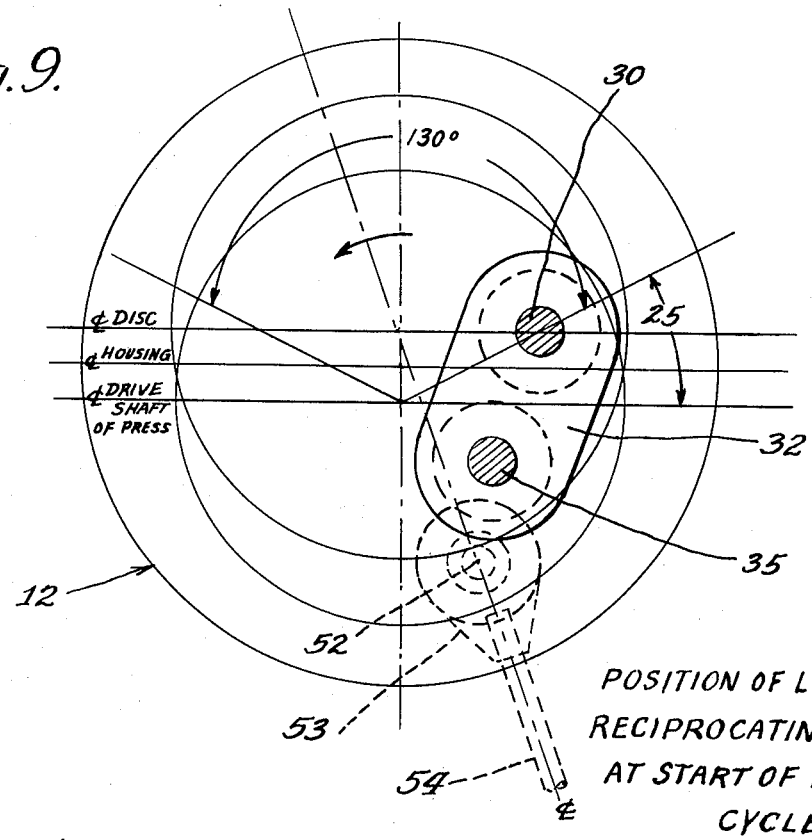
Figure 10:
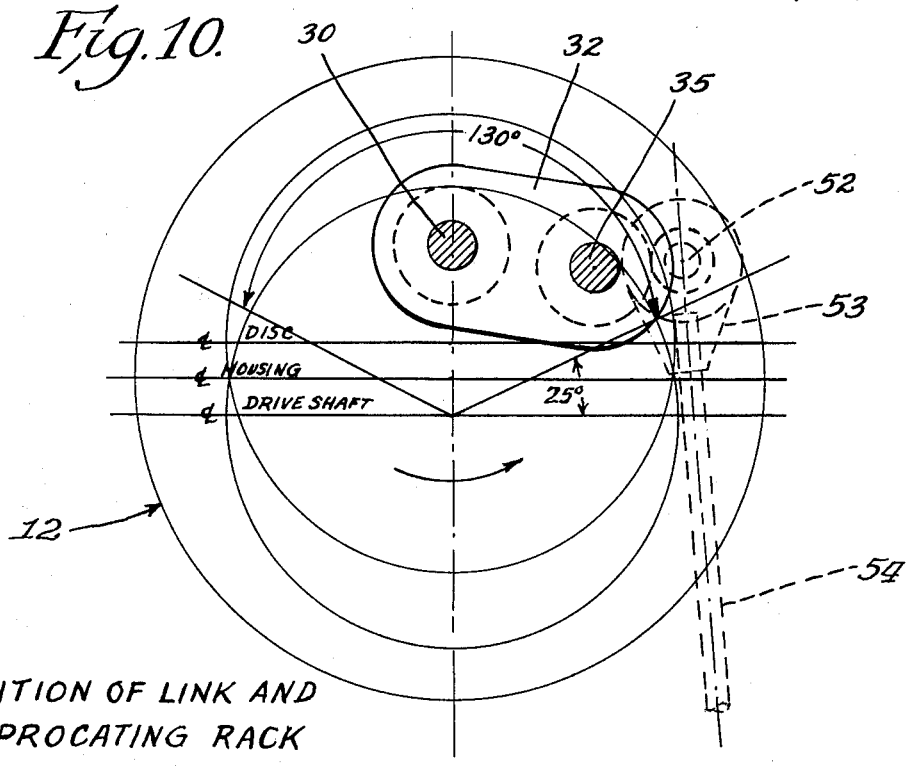
Figure 11:
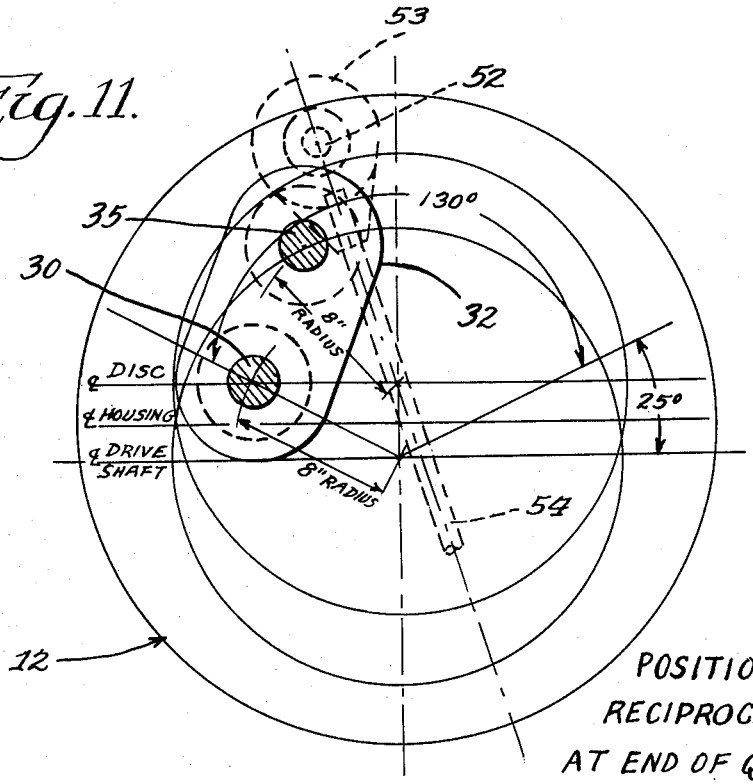
Figure 12:
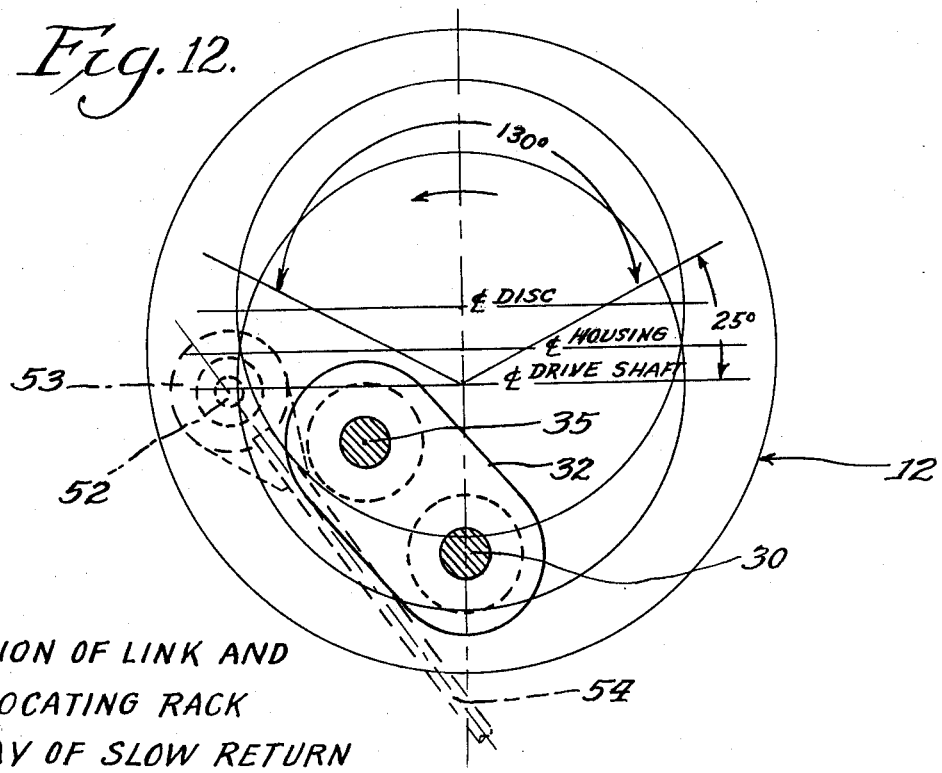

In the drawings which illustrate an embodiment of the device and werein like reference character are used to designate like parts, FIG. 1 is a fragmentary front elevational view of a forming, cutting or punch press showing the rotary drive unit of the invention together with the face plate and reciprocating rack all in operative association with the drive shaft of the press, FIG. 1A is a fragmentary front elevational view showing parts of the press not shown in FIG. 1 and which include the overrunning clutch in operative association with the reciprocating rack and the feed rolls driven thereby, FIG. 2 is a side elevational view of the structure of FIG. 1 taken substantially on line 2—2 and looking in the direction of the arrows, FIG. 3 is a sectional view taken substantially on line 3—3 of FIG. 4 and showing the disc member and the housing which mounts the disc member for rotation, FIG. 4 is a sectional view of the present rotary drive unit taken substantially on line 4—4 of FIG. 3, FIG. 5 is a fragmentary sectional view on line 5—5 of FIG. 4 and showing certain details of the collector ring structure, FIG. 6 is a detail sectional view of the brushes and collector rings taken on line 6—6 of FIG. 5, FIG. 7 is a sectional view taken on line 7—7 of FIG. 1A and showing the reciprocating rack and its operative association with the hub of the overrunning clutch, FIG. 8 is a sectional view showing details of the overrunning clutch, FIG. 9 is a schematic view showing the position of the link member and the reciprocating rack at the start of a feeding cycle, FIG. 10 is a schematic view similar to FIG. 9 but showing the parts in the mid-position of a quick feeding cycle, FIG. 11 is a schematic view similar to FIG. 9 but showing the parts at the end of a quick feeding cycle, FIG. 12 is a schematic view similar to FIG. 9 but showing the parts in the mid-position of the slow return cycle, and FIG. 13 is a schematic view illustrating means for adjusting the position of the housing and thus the disc member for obtaining feed cycles which differ as regards the degree of press shaft rotation.

Referring to FIGS. 1, 1A and 2, the press selected for illustrating the invention and which may be a forming, cutting or punch press or the like is shown as essentially consisting of a frame 10 journalling a drive shaft 11 for rotation, the drive shaft projecting from the frame into a circular housing generally indicated by 12. During operation of the press, the drive shaft 11 has substantially uniform rotation as regards speed and the housing encloses the operative elements of the present rotary drive unit. The circular housing includes a base member 13 having a secured relation to the press frame and a body part in the form of a drum type member 14 secured to and projecting forwardly of the base member. The end of the drive shaft located within the circular housing has a sprocket wheel 15 suitably mounted thereon and fixed thereto. A chain 16 passes over the sprocket wheel and the chain at its opposite end operatively connects with another sprocket wheel 17 as shown in FIG. 1A for operating the mechanism for lifting the feed rolls and which will be presently described in detail in connection with the feed roll structure. A collector ring indicated in its entirety by numeral 18 is also located on and fixed to the drive shaft 11. Details of the said collector ring are shown in FIGS. 5 and 6. The collector is necessary in order to supply electric current to a motor in the face plate for pulsing the motor so that the operator can micro-adjust the reciprocating rack during operation. The collector ring and associated parts will be explained in more detail as the description proceeds.

As best shown in FIG. 4, the hub portion 20 which is flanged at 21 is suitably fixed to the drive shaft 11 inwardly of the collector ring, and the said flanged hub portion, collector ring and sprocket all rotate with the drive shaft. The flange 21 is provided in order that the drive ring 22 which is mounted on the hub portion 20 may be adjustably fixed to the said hub so as to also rotate with the drive shaft. For this purpose the flange 21 is formed with a plurality of arcuate openings 23 spaced equally around the flange for receiving the bolts 24. The hexagonal shaped head 25 of each bolt retains a washer 26 in place against the flange and the body of the bolt passes through its particular arcuate opening 23 so that the threaded end 27 may be threaded into the drive ring 23. FIG. 3 shows six arcuate openings in the flange of the hub portion with 6 bolts 24 for securing the drive ring in desired adjusted position on the flange. The adjustment is necessary in order that the feeding stroke of the reciprocating rack may be precisely timed with the rotary action of the drive shaft. The terminal end of the drive shaft is flush with the hub portion and this end of the hub is reduced in diameter at 28 to receive the drive ring which is angularly adjusted and then secured in position on the hub portion as previously described.

The drive ring 22 is one of the operating elements of the present rotary unit since in accordance with the invention the ring carries a crank pin 30 best shown in FIG. 4 as welded or otherwise fixedly secured to the drive ring and being located eccentrically as regards the axis of rotation of the drive shaft. The fixed end of the crank pin is slightly larger in diameter than the forwardly projecting journalling end, the said end having suitably mounted thereon the roller bearing device 31. By means of the roller bearing device, the link member 32 is journalled on the crank pin 30 for substantially frictionless pivotal movement. Said link member is the second operating element of the present rotary drive unit and the same may be properly referred to as a drag link since its operating function is to drag a rotatable disc member around to impart rotary movements to the same.

The third operating element of the present rotary drive unit comprises the disc member 34 which is mounted for rotation by the circular housing part 14. As shown in FIG. 4, the axis of rotation of the drive ring 22 and the drive shaft 11 is below the center of the housing 14 and the center of rotation of the disc member is above the center of the housing for substantially the same distance. Thus for this embodiment, the disc member 34 will have such non-uniform rotation as to cause the reciprocating rack to have a quick feeding stroke in an up direction and a slow return or inoperative stroke in a down direction. See FIG. 9. The operating connection between the link member 32 and the disc member 34 includes the second crank pin 35 and which has its end of slightly larger diameter anchored and securely fixed in the disc member at a location which is eccentric to the axis of rotation of the disc member. The link member 32 has substantially frictionless journalling relation with the projecting end of the second crank pin 35 by means of the roller bearing device 36. Accordingly, during operation of the rotary drive unit, each end of the link member has pivotal movement with respect to a rotatable element.

The rotary movements of the disc member are also made substantially frictionless by means of the ball bearings 37 which are located at spaced intervals around the periphery of the disc member. The inside race of each ball bearing device is held to the disc member by the threaded bolts 40. The outside portion of each bearing device is held to the circular front plate 41 of the housing by the retaining ring 42 secured to said stationary front plate by the threaded bolts 43. The disc member is thus mounted for rotation by the housing which may be considered a part of the frame of the press and said member provides a closure plate for the housing which thus contains the link member and the drive ring.

A face plate generally indicated by numeral 45, FIGS. 2 and 3, is secured to the front surface of the disc member 34 by the securing bolts 46. The bolts pass through the rear wall 47 of the face plate and said plate is substantially circular in shape as outlined by the enclosing circular wall 48. The face plate provides spaced gibs 50 which extend diametrically of the plate to form a guideway for the adjustable block 51. The extending trunnion 52 journals the head 53 of the reciprocating rack 54. The block 51 is sdjustable diametrically of the face plate since the elongated threaded actuating shaft 55 has threaded connection with the block and actuation of the shaft is effected by the electric motor 56. The gearing connection between the motor and shaft is not shown since structure of this kind has been previously employed as shown in the Wiig U.S. Pat. No. 3,359,825 granted Dec. 26, 1967. Rotation of the actuating shaft 55 by pulsing the motor 56 will produce eccentric movement of the block 51 and corresponding adjusting movement of the journalling trunnion 52 to increase or decrease the eccentricity of the trunnion and thus the stroke of the rack. The position of the trunnion as shown in FIG. 2 is approximately half way between zero and maximum eccentricity. Since the face plate structure is fixedly secured to the disc member, the said face plate has the same non-uniform rotary movements as the disc member.

The reciprocating rack 54 extends downwardly at an angle to operatively connect with the feed roll mechanism as best shown in FIG. 1A. The frame 10 of the press suitably supports a pair of spaced journalling posts 57 which journal the shafts 58 and 60 for the upper feed roll 61 and the lower feed roll 62 respectively. The drive shaft 60 for the lower feed roll 62 extends to the left of post 57 to receive the gear 63 having meshing relation with gear 64 on the left hand projecting end of shaft 58. The two feed rolls are thus geared to rotate together and to a like extent. The shaft 60 extends further to the left to pass through the post 65 and beyond to extend into the annular collar 66 where the shaft has suitably keyed thereto the hub 67 of the overrunning clutch generally indicated by the numeral 68. The collar 66 has free rotation on the shaft 60 by means of the telescoping extensions 70, the extension to the left carrying the pinion 71 which is fixed thereto and has meshing relation with the rack 54 within the housing 72, see FIG. 7.

When the rack has an up stroke, the same is operative to rotate the pinion 71 and the collar 66 in a counter-clockwise direction, FIG. 8, and thus the overrunning clutch 68 transmitts said rotary movements to the hub 67 and to shaft 60 to cause rotation of the feed rolls and thus an operative feeding stroke of the reciprocating rack. On the down stroke of the rack, the clutch overruns and the shaft 60 and the feed rolls remain at rest.

The feed roll lifter mechanism previously referred to is actuated during each revolution of the drive shaft 11 to lift the top feed roll 61 from its pressure contact with the lower feed roll 62. The lifting fingers 74, FIG. 1A, have a camming relation with the shaft 75 so that as the shaft rotates the fingers are periodically actuated. Shaft 75 is journalled by the posts 76 and the left hand end of the said shaft receives the sprocket wheel 17. As previously explained, the chain 16 operatively connects the sprocket wheel 17 with sprocket wheel 15 on the drive shaft 11 and accordingly the feed roll lifter fingers 74 are actuated in timed relation with the rotations of the drive shaft.

The eccentricity of the trunnion 52 can be initially set to the desired extent by energization of the electric motor 56. However the present rotary drive apparatus provides the collector ring structure previously indicated by 18 and which is thus capable of furnishing electric current to motor 56 while the rotary drive unit is operating. The collector ring device as shown in FIGS. 5 and 6 essentially consists of the circular stationary base porton 80 which is formed of a plastic or other non-conductive material and is fixed being a stationary part of the press frame. The metal plugs 81 are contained by the insulating base 80 so as to be resiliently pressured in an outward direction and the same are suitably supplied with electric current by the main leads 82. The circular disc 83 is carried by the drive shaft 11 and this rotating part of the collector ring structure is also formed of insulating material in which is embedded the individual metal collector rings 84, five such rings being shown in FIGS. 5 and 6. Each ring is in pressure contact with a plug 81 and each ring has electric connection with a conductor 85. The conductors are held together by a casing 86 and the same passes around the drive ring and through the center opening in the disc member to electrically connect with the motor 56, FIG. 4. Three of the conductors supply three-phase alternating current to the motor 56 and the remaining two conductors are provided for pulsing the motor for micro-adjustments of the stroke of the reciprocating rack and which can thus be made during operation of the rotary drive unit.

The improvements of the present invention can best be understood by reference to the FIGS. 9 to 12 inclusive which show in simplified form the various positions of the link member 32 and the reciprocating rack 54 for a complete revolution of the drive shaft 11. With the disc member being spaced as regards its center of rotation from the center of the housing a distance above the same and with the drive shaft rotating on an axis an equal distance below the housing center, then the parts will rotate in a manner to give non-uniform rotation to the disc member and thus to the face plate 45 to produce a quick feeding stroke of 180° of the reciprocating rack in an up direction for only 130° of rotation of the drive shaft. The return of the rack for 180° will require an angular rotation of the drive shaft for 230°. Accordingly the rotary drive unit will produce a quick feeding stroke of 180° for a minor portion of each revolution of the drive shaft and a slow return stroke also of 180° for the remaining major portion of each revolution of the drive shaft.

The schematic drawing of FIG. 13 shows the housing 12 as adjustably mounted on the pins 90 which are received in the elongated openings 91. Rotation of the threaded screw 92 having a threaded connection in the fixed support 93 can be employed to vary the position of the housing 12 and thus the vertical position of the disc member mounted thereby. When the said disc member as the driven element has its center of rotation a distance above that of the housing, a feed cycle can be secured for only 130° of rotation of the drive shaft as has been described and explained in the above specification. When the disc member is lowered to the center line of the housing no eccentricity exists as regards the rotating parts and the rack will have 180° for each stroke for each half revolution of the drive shaft. When the housing and thus the disc member is lowered to a position below the axis of rotation of the drive shaft, then it is possible to obtain a slow feeding stroke of 180° in an up direction for approximately 230° of rotation of the drive shaft and a quick return of the rack for the remaining 130° of each revolution. In a commercial machine built in accordance with the invention the radius of the first crank pin carried by the drive ring was 8 inches and the radius of the second crank pin located in the disc member was the same namely 8 inches. Also the distance between the said crank pins along the length of the link member was 7 inches. Although these distances may be preferred they are not absolutely necessary to obtain the improved results of the present invention and some variation is of course possible.

What is claimed is:

1. In feeding mechanism for feeding strip material, the conbination including a housing journalling a press drive shaft adapted to rotate at substantially uniform speed, a drive ring fixed to the drive shaft and providing a first crank pin eccentric to the axis of rotation, a circular disc member mounted by the housing for rotation on an axis spaced from the axis of rotation of the drive ring, a link member having association with a second crank pin at one end thereof, said link member having location in the housing between the drive ring and the disc member and said link member at its end opposite the second crank pin having an eccentric connection with the drive shaft by having a pivotal connection with the first crank pin, the other end of the link member having pivotal connection with the disc member by means of the second crank pin which has a position in the disc member eccentrically as regards its axis of rotation, the second crank pin on the disc member having approximately the same radius as the first crank pin carried by the drive ring, and the link member having a length between crank pins which is not greater than the said radius, whereby as a result of the eccentric crank pins and the connecting link member the disc member is caused to rotate at different speeds as the drive shaft rotates so that for a minor portion of each revolution of the drive shaft the disc member is caused to rotate for 180° and will also be caused to rotate for 180° as the drive shaft rotates for the remaining major portion of each revolution.

2. Feeding mechanism of the type for feeding strip material as defined by claim 1, additionally including a face plate carried by the front surface of the disc member and providing eccentric means for a reciprocating rack.

3. Feeding mechanism of the type for feeding strip material as defined by claim 1, additionally including means for adjustably securing the drive ring to the drive shaft whereby to permit adjustments in the angular position of the drive ring on the drive shaft.

4. In feeding mechanism for feeding strip material, in combination, a housing journalling a press drive shaft adapted to have substantially uniform rotary speed during operation, a drive ring adjustably fixed to that portion of the drive shaft projecting within the housing, a circular disc member mounted by the housing for rotation on a center spaced from the axis of rotation of the drive ring, a drag link member located between the drive ring and the disc member, a first crank pin on the drive ring pivotally connecting one end of the link member therewith, a second crank pin pivotally connecting the other end of the link member with the disc member at a location eccentric to the center of rotation of the disc member, the second crank pin having a radius of 8 inches which is the same as the radius of the first crank pin, and the drag link member having a length between crank pins of 7 inches which is less than the radius, whereby the link member operatively connects the disc member to the drive shaft in a manner to cause non-uniform rotation of the disc member, and whereby the disc member may rotate 180° for a minor portion of the rotation of the drive shaft and may continue its rotation for another 180° while the drive shaft completes its major portion of rotation for each revolution of the drive shaft.

5. Feeding mechanism for feeding strip material as defined by claim 4, wherein the means for adjustably fixing the drive ring to the drive shaft includes a hub portion on the drive shaft with which the drive ring is adapted to contact, said hub portion having a plurality of arcute openings therein and threaded bolts passing through the openings respectively for threaded securement in the drive ring, and additionally including a face plate fixedly carried on the front surface of the disc member and providing eccentric journalling means for a reciprocating rack.

* * * * *